United States Patent [19]

Page, Jr.

[11] 4,286,662

[45] Sep. 1, 1981

[54] TUBING DRAIN

[76] Inventor: John S. Page, Jr., 21372 Brookhurst St. No. 312, Huntington Beach, Calif. 92646

[21] Appl. No.: 91,207

[22] Filed: Nov. 5, 1979

[51] Int. Cl.[3] ..... E21B 43/11

[52] U.S. Cl. ..... 166/317; 137/70

[58] Field of Search ..... 166/317, 319; 137/68 R, 137/70, 797

[56] References Cited

U.S. PATENT DOCUMENTS

| | | | |
|---|---|---|---|
| 2,178,845 | 11/1939 | Baker | 166/317 |
| 2,201,290 | 5/1940 | Greene | 166/317 |
| 2,589,144 | 3/1952 | Russell et al. | 137/70 |
| 3,358,770 | 12/1967 | Zandmer | 166/317 |
| 3,366,182 | 1/1968 | Solum | 166/317 |
| 3,417,822 | 12/1968 | Howell | 166/317 |

*Primary Examiner*—James A. Leppink

*Attorney, Agent, or Firm*—William W. Haefliger

[57] ABSTRACT

A well tubing drain assembly includes a tubing wall containing a bore intersecting the tubing interior and a counterbore intersecting the tubing exterior, an annular retainer in the counterbore having connection to the wall, the retainer forming a side drain passage, a retainer member carried by the retainer and projecting into the drain passage, a closure in alignment with the drain passage and retained by the member at the side thereof closest to the tubing bore interior, the closure closing off said tubing wall bore, the closure adapted to be blown out the drain passage when fluid pressure in the tubing bore transmits sufficient force via the closure to rupture said member, and a sealing washer located in the counterbore and extending about the closure to have sealing engagement therewith in response to pressure exerted on the washer by the fluid in the tubing.

6 Claims, 2 Drawing Figures

TUBING DRAIN

BACKGROUND OF THE INVENTION

This invention relates generally to tubing drains, and more particularly concerns a very simple drain assembly characterized by ease of removal and replacement as well as by assured operation at predetermined pressure level.

Oil well tubing drains are employed to drain pressurized fluid from within the tubing when the fluid pressure in the tubing is increased. Prior tubing drains are characterized as excessively complex in construction, which add to their original as well as maintenance cost or expense. One example of such a prior drain is that shown at page 4212 of the 1957 "Composite Catalogue of Oil Field Equipment and Services", published by World Oil.

SUMMARY OF THE INVENTION

It is a major object of the invention to provide a significantly improved tubing drain, as will be described. Basically, the drain assembly is receivable in a tubing wall containing a bore intersecting the tubing interior, and a counterbore intersecting the tubing exterior, the assembly comprising (a) an annular retainer receivable in the counterbore for connection to said wall, the retainer forming a drain passage, (b) a retaining member carried by the retainer and projecting into said drain passage, (c) a closure in alignment with said drain passage, the entirety of the closure retained by said member at the side thereof closest to the tubing bore interior, the closure adapted to close off said tubing wall bore, the closure adapted to be blown out said drain passage when fluid pressure in the tubing bore transmits sufficient force via said closure to rupture said member, (d) and a sealing washer to be located in said counterbore, and extending about said closure to have sealing engagement therewith in response to pressure exerted on the washer by the fluid in said tubing.

As will be seen, the annular retainer has simple threaded connection to the counterbore to retain the washer and closure piston in position so as to be easily removable upon unthreading of the retainer from the counterbore, and the piston is typically entirely located or confined at the tubing bore side of the retaining member in the form of a shear pin.

These and other objects and advantages of the invention, as well as the details of an illustrative embodiment, will be more understood from the following description and drawings in which:

DRAWING DESCRIPTION

DETAILED DESCRIPTION

Figure 1:
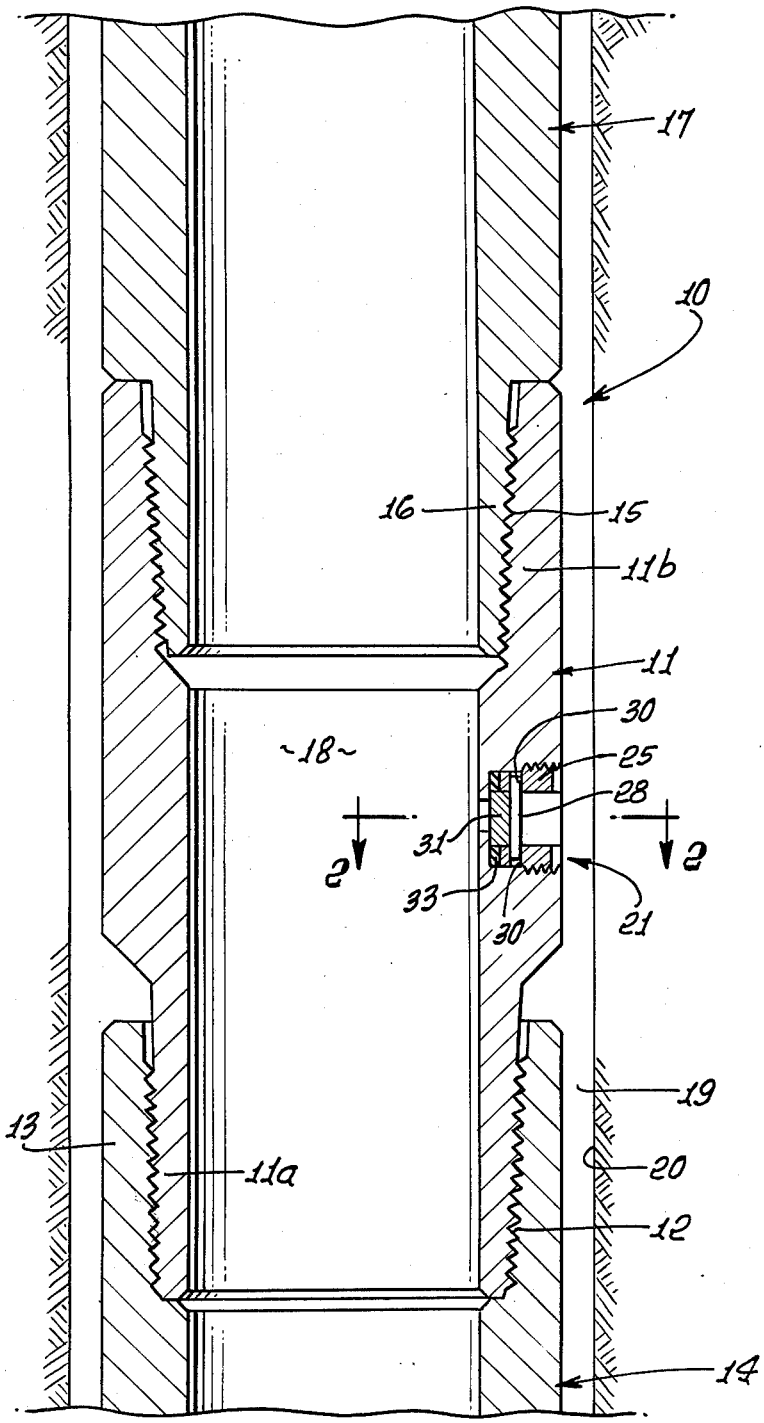
FIG. 1 is a vertical section through sub in a pipe or tubing string.
Figure 2:
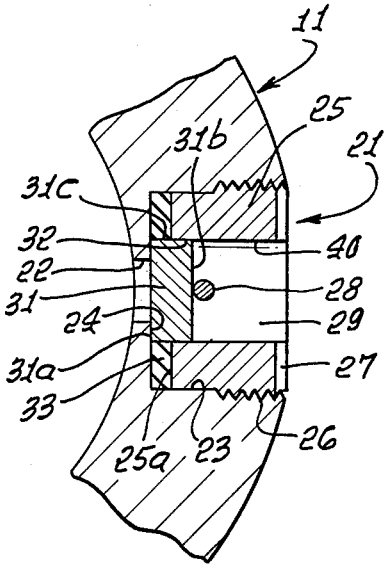
FIG. 2 is a fragmentary horizontal section taken on lines 2—2 of FIG. 1.

In FIG. 1 a pipe or tubing string 10 includes a tubular sub 11 having an externally threaded pin 11*a* connected at 12 with box 13 of lower pipe or tubing 14, and an internally threaded box 11*b* connected at 15 with pin 16 of upper pipe or tubing 17. At times, it is desired that the fluid in the tubing be released to the tubing exterior or annulus 19, within well 20.

In accordance with the invention, a tubing drain assembly 21 is provided in the wall of the tubing, for automatically draining the fluid pressure when it reaches a predetermined level. The wall contains a cylindrical bore 22 and cylindrical counterbore 23, these being coaxial, the bore 22 intersecting the tubing interior 18, and the counterbore intersecting the tubing interior 19. An annular shoulder 24 demarks the intersection of the bore and counterbore.

The drain assembly includes an annular retainer 25 in the counterbore and having connection to the tubing wall. Such connection may be afforded by threading at 26, and the outer end of the retainer may be slotted at 27 to receive a tool to rotate the retainer into or out of position, thus facilitating quick disassembly and cleanout, or replacement, of the drain assembly. The retainer carries a retaining member such as a shear pin 28 projecting into a central drain passage 29 formed by the annular retainer. Pin 28 preferably extends completely across passage 29 and is supported in drilled openings 30 in opposite sides of the retainer.

The assembly also includes a closure, as for example disc-shaped piston 31, partly received in bore portion 32 formed by the retainer, at the side of the pin closest to the sub interior 18. The closure inner face 31*a* typically firmly engages shoulder 24, whereas its outer face 31*b* firmly engages pin 28. Also, the closure closes off the tubing wall bore 22. A sealing washer 33 is located in counterbore 23 between the inner end 25*a* of the closure and the radially outer portion of shoulder 24, to seal about the radially outer cylindrical surface 31*c* of the piston closure. Fluid pressure within the sub interior 18, gaining access to the inner face 33*a* of the washer 33, squeezes it toward the retainer 25, causing the inner diameter of the washer to increase its sealing engagement with the piston and also with the retainer face 25*a*. This prevents leakage from the drain prior to sudden rupture of the assembly. Washer 33 is typically elastomeric, and may consist of rubber.

Such rupture occurs when the fluid pressure reaches a predetermined level, or level range, characterized in that fluid pressure exerted on the piston face 31*a* causes the piston to shear or fracture the pin 28. At such time, the piston, and ruptured pin extent at the outer side of the piston are blown out the drain passage 29, to the exterior, to relieve the pressure in the sub.

Of unusual advantage are the simplicity and effectiveness of the assembly construction and mode of operation, as described, as well as the ease of replacement or repair. Thus, the user may quickly unscrew the retainer 25 and remove the elements 31 and 33. The fractured pin remnants may be removed from the retainer and replaced by a new pin, and the parts quickly returned to the counterbore 23. The fewer number of parts, as compared with prior devices, contributes to these advantages and results. The fact that the piston is entirely confined at the sub interior side of the rupturable pin contributes to enhanced simplicity, and ease of parts removal and replacement, as well as assured pin rupture at predetermined pressure level.

The outer diameter of circular disc or piston 21 is slightly less than the inner diameter or bore diameter 40 of the retainer, to facilitate blow-out of the piston.

I claim:

1. In an oil well tubing drain assembly, (a) a tubing wall containing a bore intersecting the tubing interior and a counterbore intersecting the tubing exterior, (b) an annular retainer in the counterbore having connection to said wall, the retainer forming a side drain passage, (c) a retaining member carried by the retainer and projecting into said drain passage, said retaining member comprising a pin extending across said drain passage and received in drilled passages in the retainer, (d) a closure in alignment with said drain passage and retained by said member with a surface of the closure located at the side of said member closest to the tubing bore interior, the closure closing off said tubing wall bore, the closure adapted to be blown out said drain passage when fluid pressure in the tubing bore transmits sufficient force via said closure to rupture said member, said closure comprising a disc-shaped piston having a diameter approximately the same as the diameter of said drain passage, (e) and a sealing washer located in said counterbore and extending about said closure to have sealing engagement therewith in response to pressure exerted on the washer by the fluid in said tubing, said washer being elastomeric and located in engagement with the end of said retainer closest to the tubing bore interior.

2. The assembly of claim 1 wherein the annular retainer has threaded connection to said counterbore.

3. The assembly of claim 1 wherein the washer has an inner diameter approximately the same as the outer diameter of said piston.

4. The assembly of claim 1 including a tubular sub defining said wall, the sub having threaded pin and box ends for connection in a string of oil wall tubing.

5. The assembly of claim 1 wherein the piston is entirely confined at the side of the pin closest the tubing bore interior.

6. In a well tubing drain assembly to be received in a tubing wall containing a bore intersecting the tubing interior and a counterbore intersecting the tubing exterior, the assembly comprising (a) an annular retainer receivable in the counterbore for connection to said wall, the retainer forming a drain passage, (b) a retaining member carried by the retainer and projecting into said drain passage, said retaining member comprising a pin extending across said drain passage and received in drilled passages in the retainer, (c) a closure in alignment with said drain passage, the entirety of the closure retained by said member with a surface of the closure located at the side of said member closest to the tubing bore interior, the closure adapted to the close off said tubing wall bore, the closure adapted to be blown out said drain passage when fluid pressure in the tubing bore transmits sufficient force via said closure to rupture said member, said closure comprising a disc-shaped piston having a diameter approximately the same as the diameter of said drain passage, (d) and a sealing washer to be located in said counterbore, and extending about said closure to have sealing engagement therewith in response to pressure exerted on the washer by the fluid in said tubing, said washer being elastomeric and located in engagement with the end of said retainer closest to the tubing bore interior.

* * * * *